US006981295B2

(12) United States Patent
Duffy

(10) Patent No.: US 6,981,295 B2
(45) Date of Patent: Jan. 3, 2006

(54) DOOR CLOSER HOLD-OPEN APPARATUS

(76) Inventor: Tom W. Duffy, 2417 Elizabeth Dr., Stow, OH (US) 44224

( * ) Notice: Subject to any disclaimer, the term of this patent is extended or adjusted under 35 U.S.C. 154(b) by 0 days.

(21) Appl. No.: 11/041,330

(22) Filed: Jan. 24, 2005

(65) Prior Publication Data

US 2005/0155179 A1 Jul. 21, 2005

Related U.S. Application Data

(62) Division of application No. 10/376,189, filed on Feb. 27, 2003, now Pat. No. 6,904,643.

(51) Int. Cl.
*E05F 3/00* (2006.01)

(52) U.S. Cl. ..... 16/66; 16/82; 16/72; 16/374; 292/275

(58) Field of Classification Search ..... 16/66, 16/65, 78, 72, 67, 49, 84, 82, DIG. 17, 371, 16/374–377; 49/394; 312/319.1, 319.2, 312/325, 326; 292/DIG. 15, DIG. 29, 300, 292/275, 262

See application file for complete search history.

(56) References Cited

U.S. PATENT DOCUMENTS

| | | | | |
|---|---|---|---|---|
| 984,101 | A | 2/1911 | Millspaugh | |
| 1,353,218 | A * | 9/1920 | Coffman | 16/66 |
| 1,608,554 | A * | 11/1926 | Goldsmith et al. | 16/82 |
| 2,515,875 | A * | 7/1950 | Jones | 16/70 |
| 2,551,418 | A * | 5/1951 | Cirigliano | 422/124 |
| 2,722,035 | A * | 11/1955 | Johnson | 16/333 |
| 2,800,451 | A * | 7/1957 | Mottern et al. | 508/572 |
| 2,821,737 | A | 2/1958 | Simsich | |
| 2,965,918 | A | 12/1960 | Leanza | |
| 3,518,715 | A * | 7/1970 | Weiner | 16/80 |
| 3,708,825 | A | 1/1973 | Wood | |
| 4,079,479 | A | 3/1978 | Clement | |
| 4,181,337 | A * | 1/1980 | Muller | 292/271 |
| 4,194,264 | A | 3/1980 | Stoffregen | |
| 4,301,570 | A * | 11/1981 | Thomas | 16/85 |
| 4,639,969 | A | 2/1987 | Obenshain | |
| 4,723,765 | A * | 2/1988 | Pearson | 267/64.12 |
| 4,744,548 | A | 5/1988 | Hathaway | |
| 4,813,100 | A | 3/1989 | King | |
| 4,815,163 | A | 3/1989 | Simmons | |
| 4,979,769 | A * | 12/1990 | Salyer | 292/338 |
| 5,048,150 | A * | 9/1991 | Guerin | 16/49 |
| 5,575,513 | A | 11/1996 | Tuttle | |

(Continued)

FOREIGN PATENT DOCUMENTS

| | | | |
|---|---|---|---|
| DE | 3923450 | A1 * | 1/1991 |
| JP | 2004218317 | A * | 8/2004 |
| WO | WO 9612077 | A1 * | 4/1996 |

*Primary Examiner*—Chuck Y. Mah
(74) *Attorney, Agent, or Firm*—Hudak, Shunk & Farine Co., LPA

(57) ABSTRACT

The present invention relates to a hold-open apparatus for controlling the position of a door, preferably a screen door or storm door. The apparatus is used in conjunction with a piston assembly and can maintain a door in a predetermined open position, such as about 45° to about 100° in relation to a closed position. In a preferred embodiment, the apparatus can automatically lock and/or unlock when the door reaches predetermined positions. The apparatus advantageously can be retrofitted to existing door assemblies.

17 Claims, 3 Drawing Sheets

U.S. PATENT DOCUMENTS 5,592,780 A 1/1997 Checkovich
5,659,925 A 8/1997 Patterson
5,832,562 A * 11/1998 Luca ..... 16/71
5,855,039 A * 1/1999 Crawford ..... 16/49
2002/0066229 A1 * 6/2002 Rubio ..... 49/139
2004/0168284 A1 9/2004 Duffy

* cited by examiner

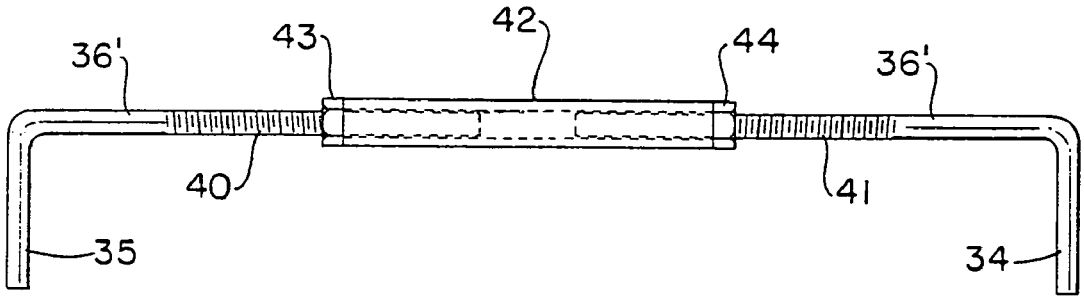
FIG.-5
FIG.-6
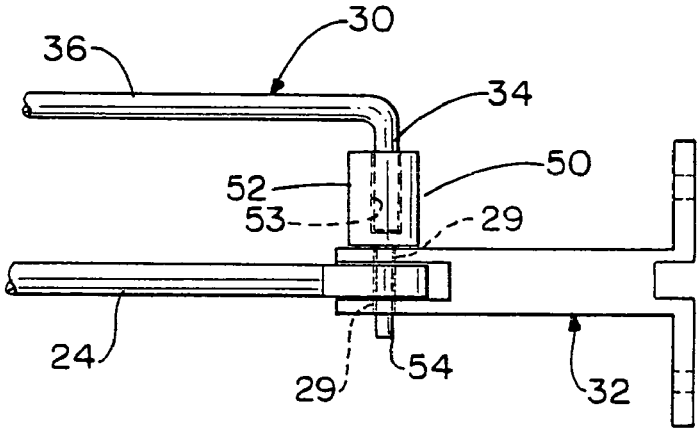
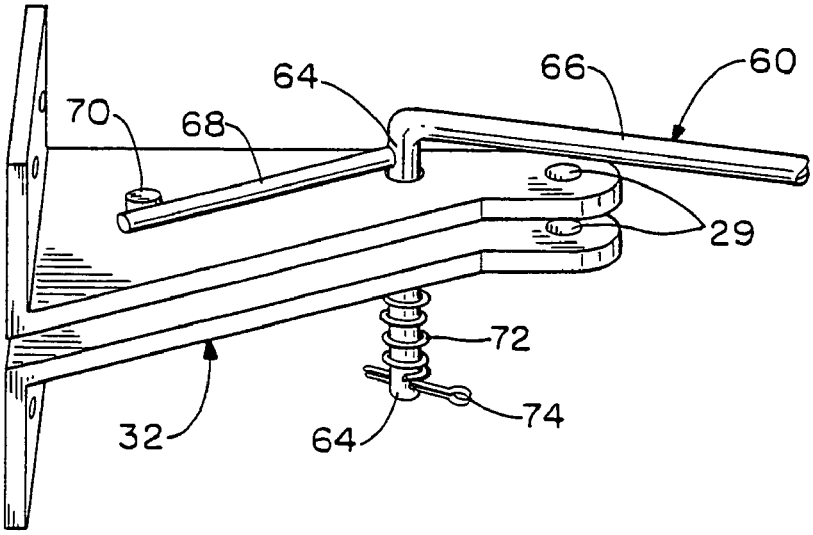
FIG.-7

DOOR CLOSER HOLD-OPEN APPARATUS

CROSS REFERENCE

This is a division of application Ser. No. 10,376,189, filed on Feb. 27, 2003, now U.S. Pat. No. 6,904,643, granted Jun. 14, 2005, of Tom W. Duffy for DOOR CLOSER HOLD-OPEN APPARATUS.

FIELD OF THE INVENTION

The present invention relates to a hold-open apparatus for controlling the position of a door, preferably a screen door or storm door. The apparatus is used in conjunction with a piston assembly and can maintain a door in a predetermined open position, such as about 45° to about 100° in relation to a closed position. In a preferred embodiment, the apparatus can automatically lock and/or unlock when the door reaches predetermined positions. The apparatus advantageously can be retrofitted to existing door assemblies.

BACKGROUND OF THE INVENTION

Screen doors, storm doors and the like, are utilized on millions of homes to provide fresh air, weather protection, and security, etc. The door typically includes a means for closing the door such as a spring or piston assembly or the like.

A popular means for controlling the door position utilizes a piston assembly which typically includes a cylindrical tube attached at one end to a bracket connector on the door. The inner surface of the cylindrical tube generally includes a spring loaded piston attached to a reciprocating connecting rod which extends from the piston and out of the tube. The end of the connecting rod opposite to the end carried and connected within the cylindrical tube typically is attached to a bracket which is connected to the door frame. When the door is opened, the connecting rod is pulled from the cylindrical tube, causing the piston to travel within the inner surface of the cylinder and thereby compress a spring coiled between an inner wall of the cylinder and the piston. When the door is released, energy stored within the spring pushes against the surface of the piston, causing it to slide within the cylinder and the connecting rod is drawn back within the cylindrical tube thereby closing the door. The retracting momentum of the piston is typically cushioned by compression of fluid such as air or oil inside the cylinder tube to create a damping resistance opposite the force that propels the door to close for better control of the speed and force at which the door closes.

Many different devices have been invented in order to maintain the door in a certain position, i.e., partially or completely open. One such device is a hold-open washer which has an aperture through which the connecting rod extends. The hold-open rod must be manually set once the door is opened at a position along the connecting rod. After the door is released, the connecting rod begins to be drawn back within the cylinder and is stopped when the hold-open washer makes contact with the end of the cylinder, binding the hold-open washer against the piston rod. The door will remain held in place until the door is opened and the hold-open washer is manually repositioned transversely along the connecting piston rod and away from the cylindrical tube.

U.S. Pat. No. 3,708,825 relates to a door check and door stop combination. The door check is made up of a pneumatic cylinder and piston which control the rate at which the door closes to prevent the door from slamming. A stop is attached to the distal end of the piston rod and lies along the side of the cylinder. The stop is made of a sheet material and has an aperture through it which receives the cylinder. The stop has a handle which may be engaged by the user's hand to move the stop from position in engagement with the cylinder.

U.S. Pat. No. 4,639,969 relates to door closer mechanism for attachment to, or incorporation into, a standard spring type door closer, or for use with a standard spring type door closer. A reversible pawl and ratchet assembly operating on a rod between the door and door casing allows the door to ratchet open where it is held by the pawl until a slight closing pull or push on the door reverses action of the pawl and allows the door to close. While the door is closing or is fully closed, reopening of the door resets the pawl for again holding the door open as desired.

U.S. Pat. No. 4,815,163 relates to a storm door lock apparatus set forth wherein a clamp is secured to an associated screen-door type closure member that further secures a slidable rod mounted with an abutment surface for actuation by a user with a pivoted lever at the other end of said rod for canting about a piston rod associated with a door closure. Additionally, a generally "L" shaped link is securable to the abutment member for allowing engagement and access by a user.

U.S. Pat. No. 5,575,513 relates to a receptacle for propping the cylinder of a cylinder-and-plunger strut in extended position of the strut includes two side-by-side cylindrical chambers, one being of a size to embrace the jack plunger rod but not the jack cylinder and the other chamber being of a size to slide over the jack cylinder, which chambers are interconnected by a slot sufficiently narrower than the jack plunger rod to enable the receptacle to move into a position embracing the jack plunger rod by snap action, and the larger chamber being of a size to slide lengthwise over the cylinder and having in it a lengthwise slot sufficiently narrow so as not to be able to pass the cylinder through it but sufficiently wide to pass the plunger rod through it.

U.S. Pat. No. 5,592,780 relates to an apparatus for controlling the position of a door suitable for use in association with door closing piston assemblies having a spring-biased reciprocable door closing piston rod and a latch plate transversely slidable along the length of the piston rod.

U.S. Pat. No. 5,659,925 relates to a holding mechanism attached to a generic door closing cylinder.

There are various disadvantages inherent in all of the prior art devices. To the Applicant's knowledge, none can be automatically locked open and released by simply moving the door without manual intervention. The prior art devices are often rather clumsy to manipulate when attempting to set or release a latch. Other disadvantages of the prior art devices are that they are rather complicated, hard to maintain, and expensive to produce.

SUMMARY OF THE INVENTION

The present invention discloses and describes a device including a hold-open apparatus which can be used in combination with a screen or storm door piston assembly. Piston assemblies are commonly utilized in the industry to maintain or bias a door in a closed position. The hold-open apparatus is operatively connected at one end to the piston assembly, preferably a bracket thereof which is connected to a door casing or jamb. When the door is opened to a predetermined angle with respect to the door frame, a second end of the apparatus can be engaged with a cylinder end of the piston assembly and hold or maintain the door in an open position. Preferably the hold-open apparatus automatically engages and disengages the cylinder, unlike the prior art devices.

The hold-open apparatus is of a durable and reliable construction and can be easily and efficiently manufactured. Importantly, the apparatus can be retrofitted to an existing storm or screen door with minimal effort.

BRIEF DESCRIPTION OF THE DRAWINGS

The invention will be better understood and other features and advantages will become apparent by reading the detailed description of the invention, taken together with the drawings, wherein:

FIG. 5 is an embodiment of a hold-open apparatus having an adjustable length.

FIG. 6 illustrates a partial side view of a further embodiment of a hold-open apparatus.

FIG. 7 illustrates a partial perspective view of a further embodiment of a hold-open apparatus.

DETAILED DESCRIPTION OF THE INVENTION

Making reference now to the drawings wherein like numerals indicate like or corresponding parts throughout the several figures, a new and improved door closer hold-open apparatus will be described.

Figure 1:
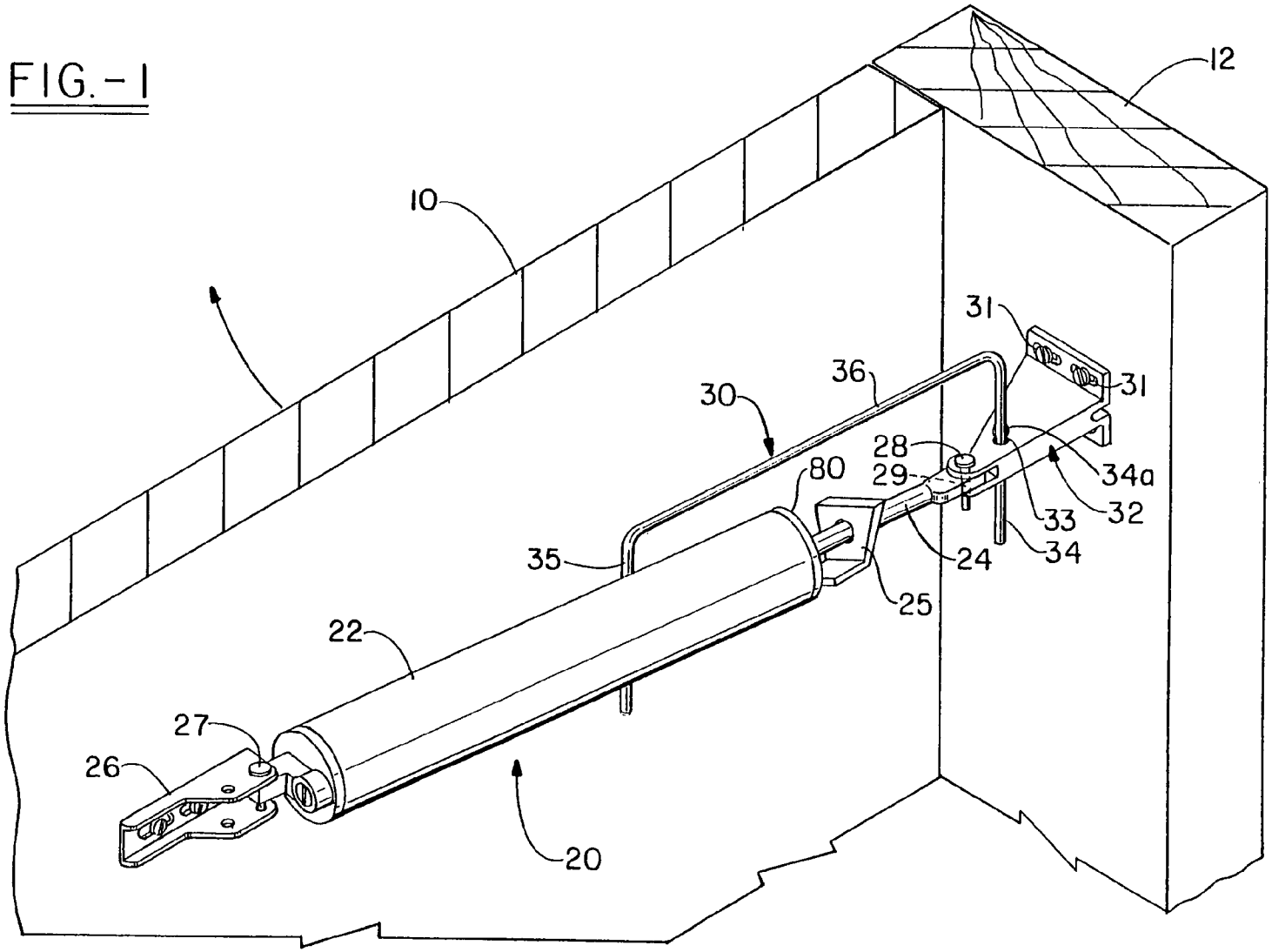
FIG. 1 is a perspective view of one embodiment of a hold-open apparatus of the present invention.

Numerous households utilize a storm, screen or a like door to moderate or protect the interior of a house from heat, cold air, insects, etc. As illustrated in FIG. 1, typically a door 10 is biased in a closed position utilizing a door closer assembly 20.

The door closer 20 generally comprises a pneumatic spring or hydraulic type dampener cylinder 22 which is connected at a head end to the door 10 by a bracket 26 through a pin 27 or other securing means. One end of reciprocating piston rod 24 is operatively connected to the cylinder 22. Attached to door casing, jamb or frame 12 at the side where the door 10 is hinged is a frame bracket 32. The frame bracket includes a means for connecting to second end of rod 24 such as bracket aperture 29. Normally an end portion of rod 24 will include an aperture which will allow pin 28 to connect rod 24 and bracket 32. The frame bracket 32 preferably includes mounting apertures 31 which are elongated to accommodate existing apertures in a door casing to allow for easy connection to door frame 12.

Upon opening the door 10, piston rod 24 which is attached to door frame 12 by bracket 32, is pulled out from within the cylinder 22. When the door is then subsequently released, the cylinder pulls against rod 24, causing the rod to be drawn back within the cylinder 22 and the door 10 is thus swung closed. The prior art door closers include a manual locking tab or washer 25 which extends around rod 24 and is moveable thereon. The tab 25 is manually set when the door 10 is opened at a position along the rod 24 that will enable the door 10 to remain open by the blocking action of the tab. The tab 25 must be again manually moved when the door 10 is to be closed.

In a preferred embodiment shown in FIG. 1, the hold-open apparatus 30 of the present invention is operatively connected at one end to the frame bracket 32, specifically through mounting aperture 33. The hold-open apparatus 30 can be formed from a rod or bar having a first end portion 34, a second end portion 35 and a central portion 36 interconnecting the ends 34, 35.

Figure 2:
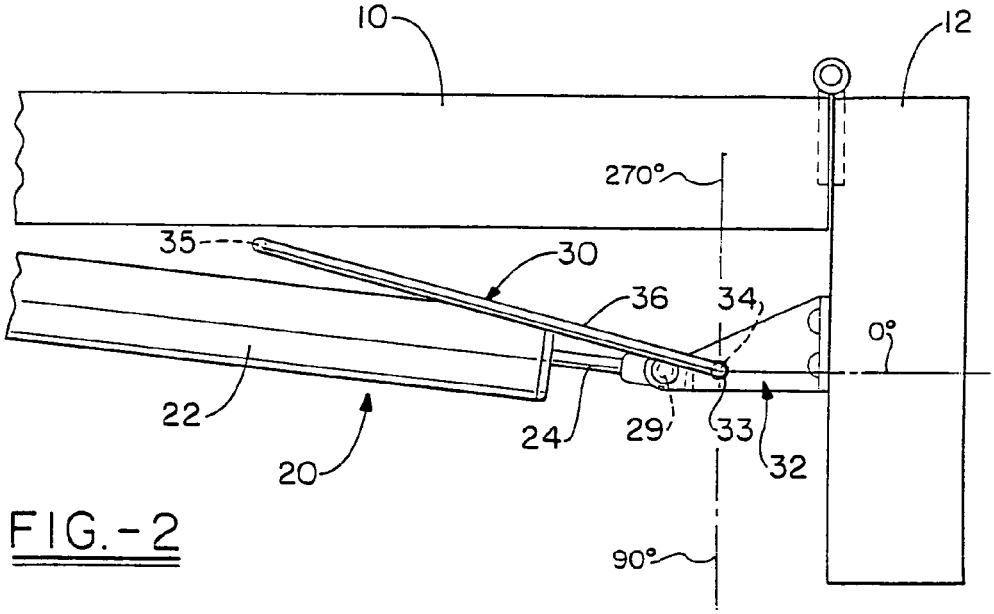
FIG. 2 is a top view of the structure shown in FIG. 1.

As shown in FIG. 2, the hold-open apparatus frame bracket mounting aperture 33, is separate from the piston rod bracket aperture 29 to isolate the closing cylinder force from hold-open apparatus in order to permit free radial movement of the hold-open rod. The hold-open apparatus mounting aperture 33 is generally located to the inside of the piston rod bracket aperture 29, closer to the door frame 12. The hold-open apparatus frame bracket mounting aperture 33 is preferably located on bracket 32 a predetermined distance away from the door frame 12 which is greater or equal to the width or thickness of the door so that the apparatus has sufficient clearance and will not bind against the door 10 when in an open position. FIG. 2 illustrates one such preferred mounting position.

Modern doors are generally about 1.5 inches thick. Earlier models are generally thinner. Therefore, it is preferred that the mounting aperture 33 edge be about 1, desirably from about 1.5, or preferably from about 1.75 inches from casing 12. Mounting aperture 33 diameter should be slightly larger than rod diameter, which preferably should be about 0.20 or about 0.25 inch or greater.

One important feature of the invention is that the hold-open apparatus frame bracket mounting aperture 33 is present on the bracket 32 having distinct angular characteristics with respect to a vertical axis or the position of the mounting bracket to produce different modes of operation. The hold-open apparatus 30 embodiments alternatively work in four distinct modes of operation, i.e., (1) lock manually and unlock manually, (2) lock manually and unlock automatically, (3) lock automatically and unlock manually, and (4) lock automatically and unlock automatically.

Figure 3A:
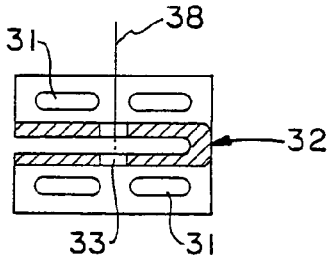
FIGS. 3A–3B illustrate end views in section of various angular positions for the apparatus bracket aperture.
Figure 3B:
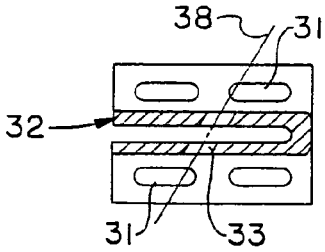

In one embodiment, the mounting aperture 33 is located so the central axis 38 is in a vertical position as shown in FIG. 3A, i.e., straight up and down, or as in further embodiments, the aperture is located incorporating a "tilt" angle of generally about 10 to about 45 degrees, desirably from about 20 to about 40 degrees, and preferably about 30 degrees, with respect to the vertical plane in a predetermined direction as shown in FIG. 3B (about 30 degrees tilt).

To be able to lock and release the door automatically, a preferred embodiment, the above-noted "tilt" angle of vertical axis 38 places the upper portion or end of the aperture 33 at a predetermined position on the bracket with respect to the surrounding structure which is discussed hereinbelow.

The position of the top edge of the bracket aperture 33 is measured in relation to a horizontal plane which runs midway through the aperture 33. A zero degree position is a line normal to the plane formed by the door casing 12 to the center of aperture 33 as shown in FIG. 2. A 270 degree position is a line normal to the plane formed by the door 10 in a closed position to the center of aperture 33 as shown in FIG. 2. Accordingly, the vertical tilt angle places the upper or top edge of aperture 33 at a position generally from about 80 degrees to about 120 degrees, desirably from about 85 to about 110 degrees, and preferably about 88 degrees to about 95 degrees, and most preferred about 90 degrees, with respect to the described horizontal plane.

In this manner, gravity is used to lock and unlock the hold-open apparatus since the hold-open apparatus 30 is biased or tilted towards the cylinder 22 and rod 24 due to the position of the mounting aperture, and automatically locks in place when the door is opened to a predetermined angle. To automatically unlock the hold-open apparatus, the door is further opened, a predetermined angle, e.g., about 5 or about 10 degrees or more past the locked open position of the door. For example, if the door is locked open by apparatus at an angle of 80 degrees, the apparatus will unlock when the door is further opened to about 85 degrees.

To maintain the hold-open apparatus central portion 36 in a relative horizontal position (see FIG. 1) as the door opens and closes, the angle between the first end 34 and the central portion 36 of the hold-open apparatus is-varied and is dependent on the tilt angle utilized if any.

Figure 4:
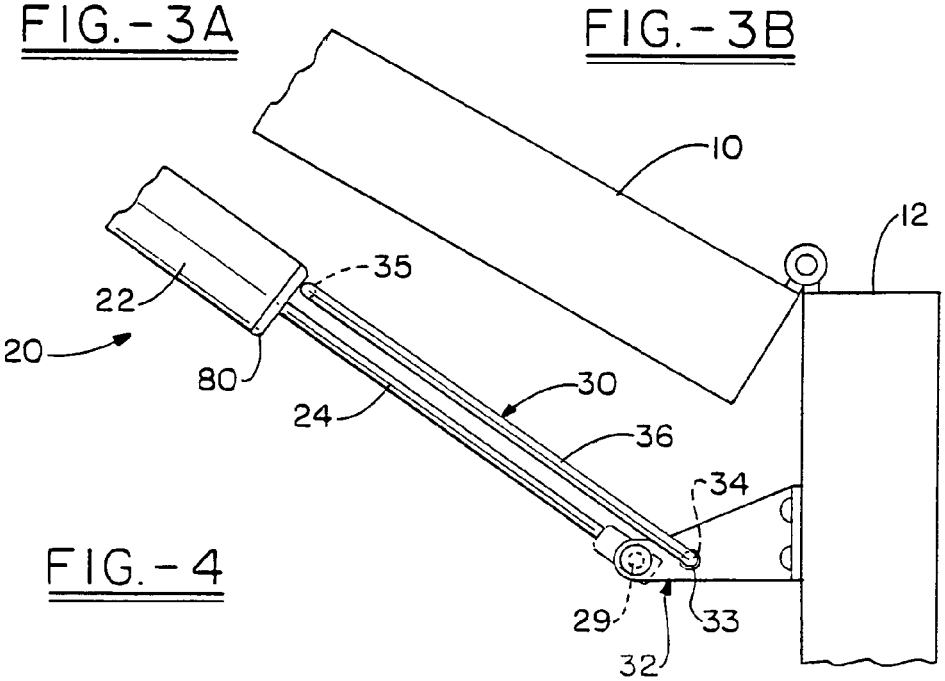
FIG. 4 is a top view of the hold-open apparatus in a locked position.

The hold-open apparatus 30 comprises a durable material, preferably a non-corrosive material such as stainless steel, core metal with nickel- alloy plating, metal reinforced plastic, or plastic either thermoplastic or thermoset. The apparatus is preferably formed from a rod, tube, or other similar construction. Generally any metal can be used, so long as the choice is strong and durable, with stainless steel being preferred. The hold-open apparatus 30 includes first end portion 34 which fits in mounting aperture 33 and is allowed to move therein. The first end 34 has a collar 34*a* (FIG. 1) or portion of greater diameter than aperture 33 to maintain the hold-open apparatus 30 at a certain height to provide clearance therefore. The central portion 36 and thus the length of the hold-open apparatus 30 extends generally about 4 to about 10 inches, desirably from about 6¾ to about 7¼, and preferably about 7 inches when measured from end to end. The length of central portion 36 is generally determined based on what angle the door is to be maintained in an open position as illustrated in FIG. 4. Generally, the longer the hold-open apparatus central portion 36, the greater angle the door will be positioned when latched open thereby. It is preferred that the hold-open apparatus 30 latches door 10 in an open position at an angle of about 45 degrees (as shown in FIG. 4) to about 100 degrees, desirably from about 70 degrees to about 95 degrees, and preferably from about 80 degrees to about 90 degrees with respect to a closed position as shown in FIG. 1.

The hold-open apparatus 30 can also be designed so as to be variable in length as known in the art to accommodate the user's choice of operation and angle of the door open position, etc. Preferably the central portion of the hold-open apparatus length may be varied by utilizing two threaded ends 40, 41, a threaded collar 42 and at least one locking element or nut 43, 44 as shown in FIG. 5.

To better understand the operation of the hold-open apparatus, it is important to note that the second or cylinder abutting end 35 of the hold-open apparatus 30 moves primarily in a horizontal plane and also in a radial arc with respect to the first end of the hold-open apparatus. In use, the first end 34 is located at the center of a circle and the second end 35 moves around a portion of the radial edge of the circle. It is also important to note that the second end 35 of the apparatus will engage in a hold-open position on the end of the closing cylinder that is closest to the door, i.e., between the cylinder and the door as illustrated in FIG. 4. There are numerous methods which can be utilized to hold a door in an open position using the hold-open apparatus.

In one embodiment, first end 34 of the hold-open apparatus 30 will be substantially perpendicular to the jam bracket with the mounting aperture 33 present in the bracket 32 located so the central axis 38 is in a substantially vertical position as shown in FIG. 3A. With this embodiment, the hold-open apparatus must manually be engaged where the second end 35 is inserted against cylinder end as shown in FIG. 4, in hold-open position, but it will automatically disengage when the door is opened beyond a predetermined angle such as about 85 degrees. Automatic locking and unlocking action can be obtained by using a spring mechanism as explained hereinbelow if desired. In the manual locking embodiment, as the door is first opened, the cylinder exterior wall guides the second end of the hold-open apparatus so the second end swings with a similar angular motion as the door until the end of the cylinder 22 is extended past the second end of the hold-open apparatus. Then, the cylinder 22 no longer applies force to the hold-open apparatus. The hold-open apparatus 30 is then locked or tapped in place manually when the cylinder end is extended past the second end 35 of the hold-open apparatus 30. When the door is then opened wider than the hold-open position, the piston rod 24 forces the hold-open apparatus towards the door and in doing so disengages the hold-open apparatus 30. To close the door, no additional force need be applied to the hold-open apparatus as the second end of the hold-open apparatus will remain stationary as the door is opened beyond the locked position and will not move to a locked open position. As the door is released, the door will close with no interference from the hold-open apparatus 30.

In further embodiments of the invention, an additional force such as from a spring, magnet or gravitation force is applied to the hold-open apparatus in order to automatically lock the door in an open position. In one embodiment, the mounting aperture 33 present in the bracket 32 is angled as described hereinabove, and gravitational force will be applied to the hold-open apparatus to provide for automatic locking of door 10 in an open position as shown in FIG. 4.

In a further embodiment, the hold-open apparatus 30 includes a male/female pin adapter 50 as shown in FIG. 6. Pin 50 is designed having a portion 54 or element thereof which can fit within the existing aperture 29 utilized to secure piston arm 24 to bracket 32 while allowing free operation of the hold-open apparatus 30. Pin 50 has a male element or fitting 54 which is inserted into aperture 29 to secure piston arm 24 of the door closer 20 in typical fashion as shown. The hold-open apparatus 30 first end portion 34 is inserted into female connection 52 and is allowed to freely pivot therein in order to latch the door 10 in positions as described herein.

If the male/female pin 50 is allowed to rotate as the door is opened and closed, no automatic action will occur, but, it is much easier to manually use as compared to the washer 25 that is commonly included with the piston assembly. When the male/female pin 50 is held fixed with, for example, a spring clip in a further embodiment, it will produce automatic locking/unlocking as explained herein. In one embodiment, the female aperture 53 present in the male/female pin is formed with an angle the same as described above for bracket aperture 33. The male/female pin 50 will provide automatic gravitationally induced locking and unlocking.

In yet another embodiment, a magnet 80 can be attached to cylinder 22 at a butt end thereof as shown in FIG. 1. As the door is opened and the end of the cylinder is extended past the second end 35 of the hold-open apparatus 30, the magnet will cause the second end of the hold-open apparatus to move towards the piston rod and will engage in a locked hold-open position. When the door is opened further, the second end of the hold-open apparatus breaks away from the magnetic force and permits an automatic disengagement allowing the door to close freely.

In yet another embodiment as shown in FIG. 7, the hold-open apparatus 60 includes a fixed coil spring 72 which is carried at the first end 64 thereof and maintained by a cotter pin 74 or other fastener means. The apparatus also includes a stop means comprising a lever or protrusion element 68 attached to the central portion 66 or end portion 64 of apparatus 60 and a binding post or stop 70 present on the bracket 32 produce automatic operation. The coil spring maintains a torque on the hold-open apparatus so the second end is always biased to move towards the piston 20 and will cause the second end of the hold-open apparatus 60 to lock open automatically when the door is opened to the desired position. When the door is further opened to a predetermined angle as noted hereinabove, and then released, the protrusion element will temporarily bind against post 70 and will permit the door to close freely.

Many varieties of springs and resistance binding methods could be used. For example, the binding point could be present between the collar on the first end of the hold-open apparatus and the bracket and would work much like that of a bicycle kick stand. Another method could incorporate parallel leaf springs that would operate on a non-concentric area of the first end of the hold-open apparatus. This method would provide a positive snap action as the hold-open apparatus locks open and also disengages.

Accordingly, the hold-open apparatus of the present invention can advantageously be utilized as an add-on accessory for a door closer mechanism which is already in use with little or no retrofitting necessary and without the need for installation tools. Alternatively, the hold-open apparatus can be included on newly constructed door closer mechanisms fitted to screen and storm doors. The present invention provides a simple method for maintaining a door in a latched position, whether operated manually, or automatically. The apparatus can be utilized by persons who have disabilities and cannot easily manipulate hands, fingers, digits, and/or bend over easily. Further, since the door can be activated to a hold-open position by simply opening the door, accidents that are caused by the closing door catching on the back of the legs or feet are minimized.

The main advantage in all cases to the user and as compared to other similar devices is that the apparatus can be operated completely automatically by simply opening and closing the door without any additional manual operation. This feature is particularly advantageous when the user has both hands full when entering, or when assisting others since the door can be automatically locked open and disengaged by simply moving the door.

In accordance with the patent statutes, the best mode and preferred embodiment have been set forth; the scope of the invention is not limited thereto, but rather by the scope of the attached claims.

What is claimed is:

1. A device for controlling the position of a door relative to a door frame, wherein the door has one end of a cylinder closing mechanism operatively attached thereto and where another end of the cylinder closing mechanism is attached to a door frame through a bracket, said device comprising:

(a) a hold-open apparatus having a first end, a second end, and an interconnecting central portion, wherein said apparatus second end is adapted to engage an end of a cylinder of the cylinder closing mechanism when the door has been opened to at least a predetermined degree to maintain the door in an open position; and (b) an adapter having a male portion which operatively connects said cylinder closing mechanism end to the bracket, and a female portion, wherein said apparatus first end is operatively connected to said adapter female portion; or (c) a spring is connected to said apparatus first end which biases the apparatus towards the cylinder closing mechanism, wherein the spring will cause the apparatus second end to automatically engage said cylinder end when the predetermined angle has been reached, and wherein said apparatus first end is operatively connected to the bracket in an aperture separate from an aperture which connects the cylinder closing mechanism to the door frame.

2. A device according to claim 1, wherein the apparatus second end is movable in a horizontal plane and in a radial arc with respect to the apparatus first end, and wherein said second end is engageable with a side of said cylinder end.

3. A device according to claim 2, wherein said apparatus central portion is length adjustable, or wherein said bracket has elongated apertures, or a combination thereof.

4. A device according to claim 1, wherein said adapter is utilized, and wherein the male portion operatively connects an end portion of a rod of the cylinder closing mechanism to the bracket.

5. A device according to claim 4, wherein the apparatus second end moves in a horizontal plane and in a radial arc with respect to the apparatus first end, and wherein said second end is engageable with a side of said cylinder end.

6. A device according to claim 5, wherein said apparatus central portion is length adjustable, or wherein said bracket has elongated apertures, or a combination thereof.

7. The device according to claim 4, wherein the adapter female portion has the shape of a cylinder having an aperture and the first end of the hold-open apparatus is operatively connected in the aperture.

8. The device according to claim 7, wherein the adapter aperture is angled about 10 to about 45 degrees with respect to vertical to allow the apparatus to be locked in place automatically when the door is opened to the predetermined degree.

9. A device for controlling the position of a door relative to a door frame to which the door is operatively connected, comprising:

a cyclinder closing mechanism adapted to have an end portion operatively connected to the door;

a bracket having a first end portion adapted to be connected to the door frame and a second end portion operatively connected to the cylinder closing mechanism;

an adapter having a pin element and a hold-open apparatus connecting portion, the pin element operatively connected in an aperture of the bracket; and a hold-open apparatus having a first end, a second end, and an interconnecting central portion, wherein the apparatus first end is operatively connected to the adapter hold-open apparatus connecting portion, wherein the apparatus second end is adapted to engage an end of a cylinder of the cylinder closing mechanism when the door has been opened at least a predetermined degree to maintain the door in an open position, and wherein the adapter hold-open apparatus connecting portion has the shape of a cylinder having an aperture, and wherein the first end of the hold-open apparatus is operatively connected in the aperture.

10. The device according to claim 9, wherein the adapter pin element operatively connects an end portion of a rod of the cylinder closing mechanism to the bracket.

11. The device according to claim 10, wherein the adapter aperture is angled about 10 to about 45 degrees with respect to vertical to allow the apparatus to be locked in place automatically when the door is opened to the predetermined degree.

12. The device according to claim 11, wherein the hold-open apparatus second end is located between the door and the cylinder closing mechanism, and wherein the predetermined degrees the door has been opened is from about 45° to about 100°.

13. The device according to claim 11, wherein an upper end of the adapter aperture is located at a position of about 80° to about 120° with respect to a horizontal plane wherein a line normal to a vertical plane of the door frame to a center of the bracket aperture represents a zero degree position.

14. The device according to claim 13, wherein the upper end of the apparatus bracket aperture is located at a position of about 85 to about 95 degrees with respect to the horizontal plane.

15. The device according to claim 10, wherein said apparatus central portion is length adjustable, or wherein said bracket has elongated apertures, or a combination thereof.

16. The device according to claim 9, wherein the hold-open apparatus second end is movable in a horizontal plane and in a portion of a radial arc with respect to the apparatus first end and such movement can be independent of cylinder movement, and wherein said second end is engageable with a side of said cylinder end.

17. The device according to claim 9, wherein said apparatus central portion is length adjustable, or wherein said bracket has elongated apertures, or a combination thereof.

* * * * *